US011221129B2

(12) United States Patent
Fang et al.

(10) Patent No.: US 11,221,129 B2
(45) Date of Patent: Jan. 11, 2022

(54) DIMMING TRACK LAMP

(71) Applicants: Self Electronics Co., Ltd., Zhejiang (CN); Wanjiong Lin, Zhejiang (CN); Self electronics USA Corporation, Norcross, GA (US)

(72) Inventors: Lei Fang, Zhejiang (CN); Jianfeng Yu, Zhejiang (CN); Zuping He, Zhejiang (CN); Jianguo Dong, Zhejiang (CN); Kai Xu, Zhejiang (CN); Jun Yang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 40 days.

(21) Appl. No.: 16/835,135

(22) Filed: Mar. 30, 2020

(65) Prior Publication Data

US 2021/0262646 A1 Aug. 26, 2021

(30) Foreign Application Priority Data

Feb. 26, 2020 (CN) ..... 202010119573.1

(51) Int. Cl.
*F21V 21/35* (2006.01)
*H05B 45/20* (2020.01)
(Continued)

(52) U.S. Cl.
CPC ..... *F21V 21/35* (2013.01); *F21V 21/29* (2013.01); *F21V 23/005* (2013.01); *F21V 23/02* (2013.01); *H05B 39/02* (2013.01); *H05B 39/06* (2013.01); *H05B 45/10* (2020.01); *H05B 45/20* (2020.01); *F21Y 2113/13* (2016.08); *F21Y 2115/10* (2016.08)

(58) Field of Classification Search
CPC ..... F21V 21/35; F21V 21/29; F21V 23/005; F21V 23/02; H05B 45/20; H05B 45/10; H05B 39/02; H05B 39/06; F21Y 2113/13; F21Y 2115/10
See application file for complete search history.

(56) References Cited

U.S. PATENT DOCUMENTS 6,135,615 A * 10/2000 Lee ..... H01R 25/147 362/147
2006/0002110 A1* 1/2006 Dowling ..... H05B 47/155 362/249.05

(Continued)

*Primary Examiner* — Wei (Victor) Y Chan
(74) *Attorney, Agent, or Firm* — Wang Law Firm, Inc.

(57) ABSTRACT

A dimming track lamp has a detachable assembly housing with a power supply track, a control circuit board electrically connected with the power supply track, a lamp body arranged on the assembly housing, a printed circuit board arranged in the lamp body, a light source on the printed circuit board and an optical element arranged in the light output direction of the light source. The control circuit board has a power supply module which is electrically connected with the power supply track, a signal input module, a signal processing module for analyzing and calculating the input signal and generating a control signal, and a signal output module for outputting the control signal to the printed circuit board. The light source has a warm light source and a cold light source, the control signal is used to control the light output of the warm light source and the cold light source.

11 Claims, 8 Drawing Sheets

(51) Int. Cl.

| | |
|---|---|
| ***H05B 45/10*** | (2020.01) |
| ***F21V 21/29*** | (2006.01) |
| ***F21V 23/00*** | (2015.01) |
| ***F21V 23/02*** | (2006.01) |
| ***H05B 39/02*** | (2006.01) |
| ***H05B 39/06*** | (2006.01) |
| ***F21Y 113/13*** | (2016.01) |
| ***F21Y 115/10*** | (2016.01) |
| ***F21V 17/02*** | (2006.01) |
| ***F21V 19/02*** | (2006.01) |
| ***F21V 21/14*** | (2006.01) |

(56) References Cited

U.S. PATENT DOCUMENTS

| | | | | |
|---|---|---|---|---|
| 2013/0063042 | A1* | 3/2013 | Bora | H05B 45/20 315/292 |
| 2020/0240600 | A1* | 7/2020 | Ho | F21S 4/24 |

* cited by examiner

DIMMING TRACK LAMP

This application claims priority to a Chinese Patent Application No. CN 202010119573.1, filed on Feb. 26, 2020.

FIELD OF THE TECHNOLOGY

The present invention relates to the technical field of lighting equipment, with particular emphasis on a dimming track lamp.

BACKGROUND

LED is widely used in daily life because of it has the characteristics of high luminous efficiency, energy efficiency and so on. At present, LED spotlights are often used in cabinets, markets and showrooms to provide lighting.

But most of the existing LED spotlights still need wire when install them, that is, the wire can't be separated from the LED spotlight during the assembly, the existence of the wire leads to the need to provide additional space for laying the wire, resulting in increased production costs, more importantly, this makes the overall structure of the lamp complex, when there is a problem, the maintenance is not convenient, and the wire is easy to cause safety problems such as aging. At the same time, this kind of the lamp combination design is not conducive to the user's personalized change according to the demand. If the lamp combination of different structures is to be adopted, has to purchase a complete set of combined lamps which including the guide rail again, and the recycling rate is not high.

SUMMARY OF THE INVENTION

Therefore, the present invention provides a dimming track lamp to solve the above technical problem.

A dimming track lamp, comprising an assembly housing which is in detachable connection with the power supply track, a control circuit board is in the assembly housing and electrically connected with the power supply track, a lamp body arranged on the assembly housing, a printed circuit board arranged in the lamp body, a light source on the printed circuit board and an optical element arranged in the light output direction of the light source, the control circuit board comprises: a power supply module which is electrically connected with the power supply track, a signal input module, a signal processing module for analyzing and calculating the input signal and generating the control signal, and a signal output module for outputting the control signal to the printed circuit board; The light source comprises a warm light source and a cold light source, the control signal is used to control the light output of the warm light source and the cold light source.

Advantageously, the signal input module comprises a brightness adjusting knob and a color temperature adjusting knob arranged on the assembly housing.

Advantageously, the assembly housing is a thin strip, which can move in the power supply track along the length direction, the brightness adjusting knob and the color temperature adjusting knob are arranged at both ends of the assembly housing, and the lamp body is arranged in the middle of the assembly housing.

Advantageously, the signal output module comprises a DC-DC unit that connected with the signal processing module, a first switching unit connected with the DC-DC unit for controlling the light output of the warm light source, and a second switching unit connected with the DC-DC unit for controlling the light output of the cold light source, the first switching unit and the second switching unit are also connected with the signal processing module.

Advantageously, the first switching unit comprises a first resistor, a second resistor, a first NPN type triode and a first PMOS transistor, wherein the first resistor and the second resistor are in series, the other end of the first resistor is connected with the positive output terminal of DC-DC unit, the other end of the second resistor is connected with the collector of the first NPN type triode; the emitter of the first NPN type triode is grounded, the base is connected with the signal processing module; the gate of the first PMOS transistor is connected on the connection line between the first resistor and the second resistor, the source is connected with the positive output terminal of the DC-DC unit, the drain is connected with the positive pole of the warm light source, and the negative pole of the warm light source is connected with the negative output terminal of the DC-DC unit.

Advantageously, the second switching unit comprises a third resistor, a four resistor, a five resistor, a second NPN type triode and a second PMOS transistor, wherein the third resistor, and the four resistor are connected in series, the other end of third resistor is connected with the positive output terminal of DC-DC unit, and the other end of four resistor is connected with the collector of the second NPN type triode; the emitter of the second NPN type triode is grounded, the base is connected with the signal processing module; the gate of the second PMOS transistor is connected on the connection line between the third resistor and the four resistor, the source is connected with the positive output terminal of the DC-DC unit, the drain is connected with the positive terminal of the cold light source; the negative terminal of the cold light source is connected with the negative output terminal of the DC-DC unit; one end of the five resistor is connected with the positive output terminal of the DC-DC unit, and the other end is connected with the drain of the second PMOS transistor.

Advantageously, the lamp body comprises: a shell is provided with a light outlet; a rotary seat is fixed in the housing, and the printed circuit board is arranged on one side of the rotary seat which toward the light outlet; a rotary connecting rod, one end is connected with the rotary seat so that the lamp body can rotate vertically around the connecting part, and the other end is connected with the assembly housing so that the lamp body can rotate horizontally around the connecting part.

Advantageously, one end of the rotary connecting rod connected with the rotary seat is a ball head structure, and the rotary seat comprises a first part and a second part of a spherical cavity which can accommodate the rotation of the ball head structure after splicing.

Advantageously, the interior of the spherical cavity has an elastic member butted between the ball head structure and the spherical cavity.

Advantageously, the assembly housing is a thin strip, comprising a base plate, a left plate, a right plate and a top plate extending along the length direction, and the top plate is provided with a mounting hole which is rotationally matched with the end of the rotary connecting rod.

Advantageously, the assembly housing comprises a rotation limiting member preventing the excessive rotation of the rotary connecting rod.

Advantageously, the rotation limiting member is a limiting gasket located at the inner side of the base plate, the rotary connecting rod is provided with a first limiting protrusion, and the limiting gasket is provided with a second limiting protrusion to resist the first limiting protrusion to prevent the rotary connecting rod from excessively rotating.

Advantageously, the outer edge of the limiting gasket extends along the length direction of the assembly housing to form a third limiting protrusion, and the two sides of the third limiting protrusion are respectively butted with the inner sides of the left plate and the right plate, so that the limiting gasket can rotate finitely.

The dimming track lamp of the present invention can realize the function of adjusting brightness and color temperature at the same time, and integrate the control circuit board into the assembly housing which is in detachable connection with the power supply track, so that the heat generated by the control circuit board which controls dimming can be quickly exported through the power supply track, so that the volume of the track and the assembly housing can be manufactured smaller, the dimming track lamp has high power and can be used in small track.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
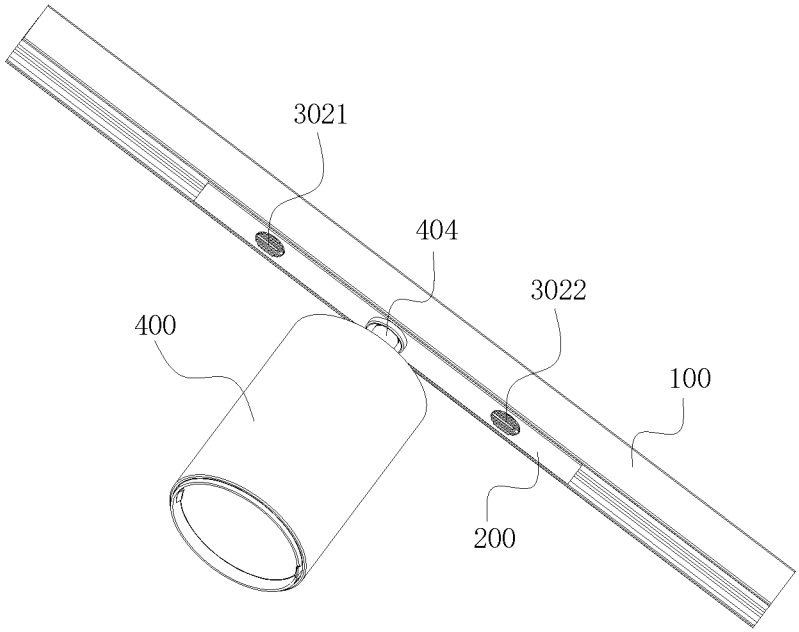
FIG. 1 is a structural diagram of the dimming track lamp (with the power supply track) in an embodiment of the present invention.
Figure 2:
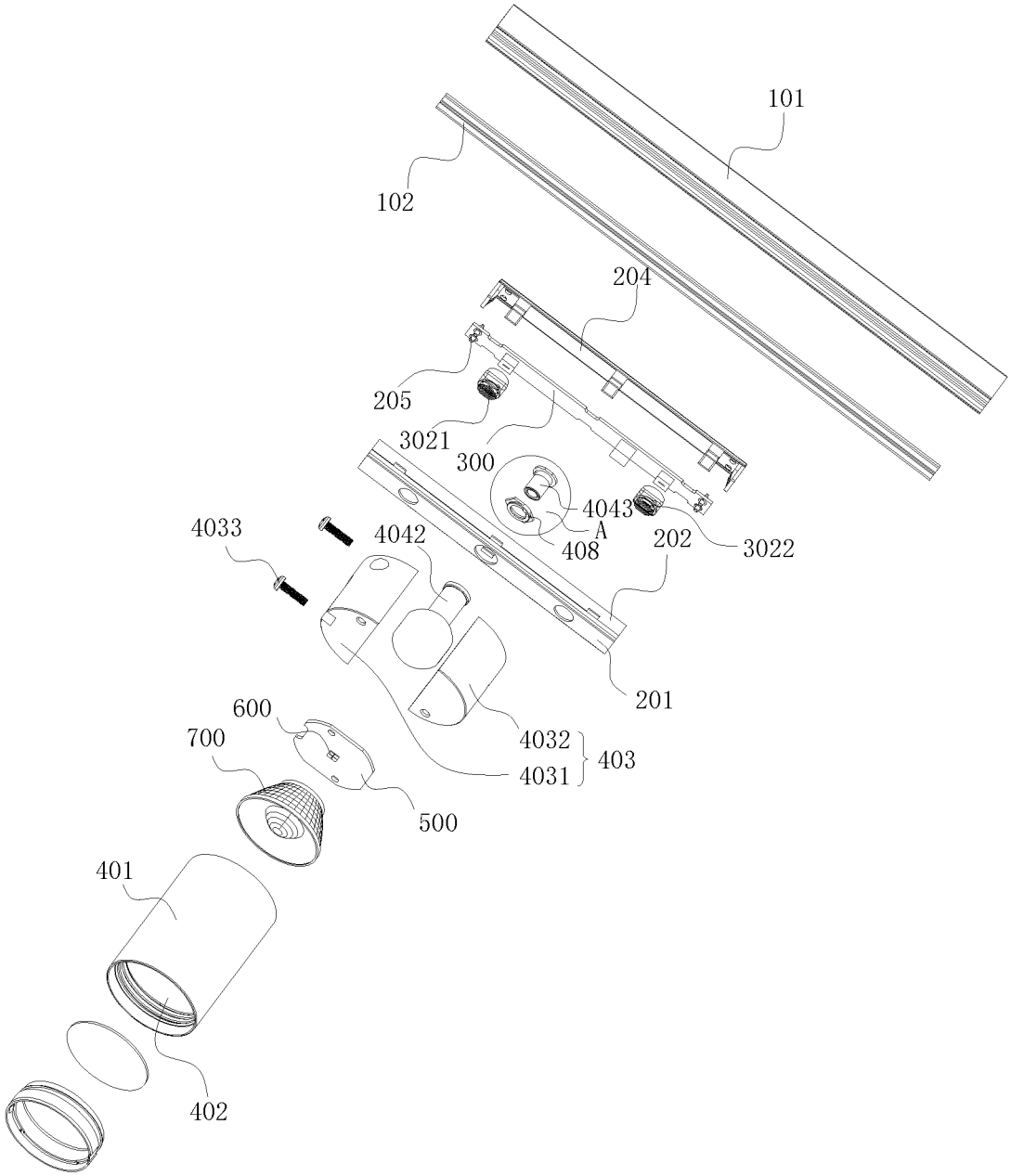
FIG. 2 is an exploded diagram of the dimming track lamp (with the power supply track) in an embodiment of the present invention.
Figure 3:
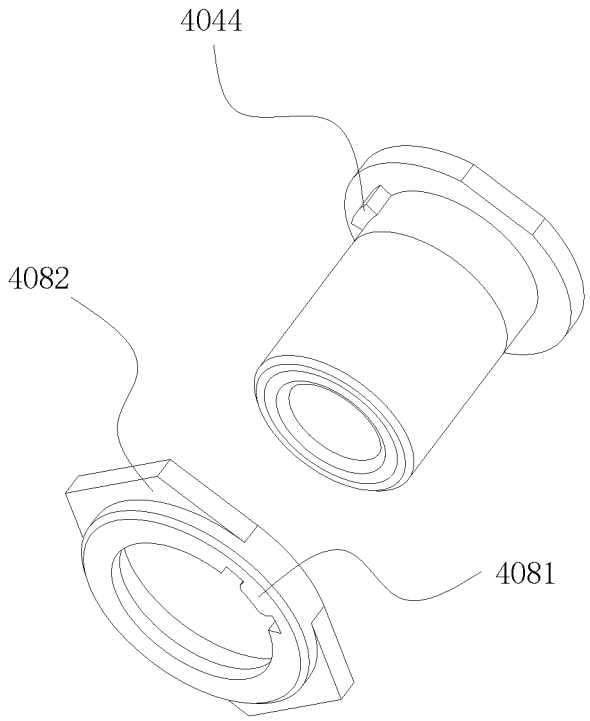
FIG. 3 is an enlarged diagram of part A in FIG. 2.
Figure 4:
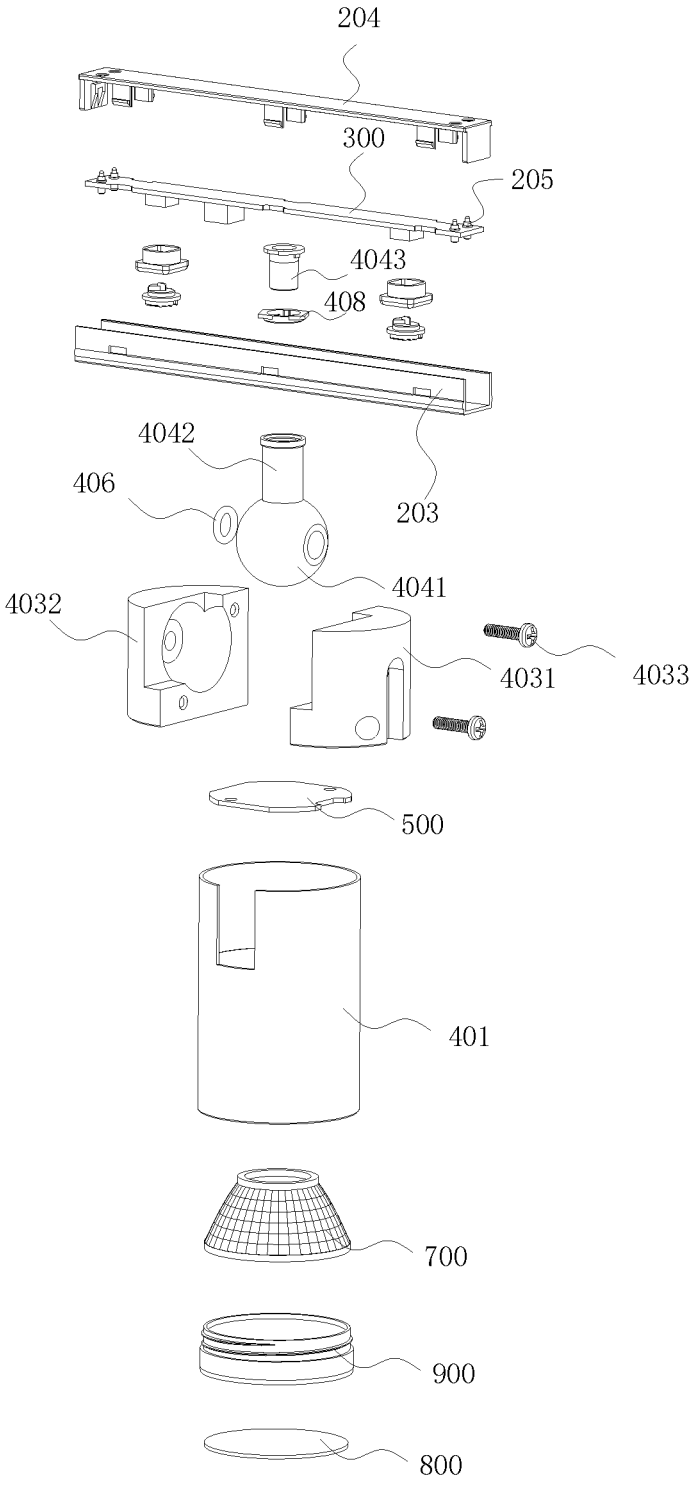
FIG. 4 is an exploded diagram of the dimming track lamp (without the power supply track) in an embodiment of the present invention.
Figure 5:
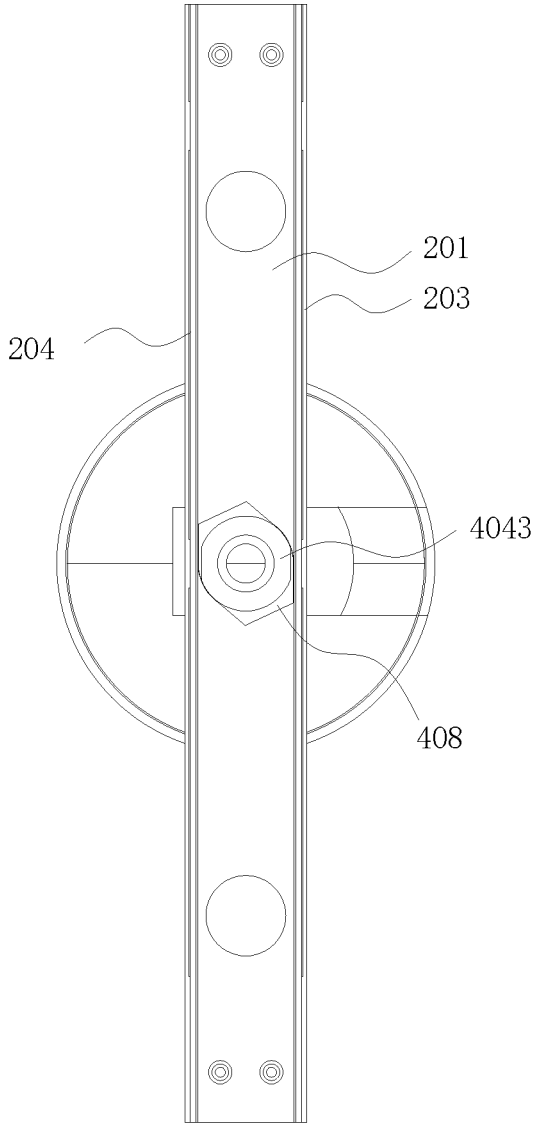
FIG. 5 is a structural diagram of the interior of the assembly housing of the dimming track lamp in an embodiment of the present invention.
Figure 6:
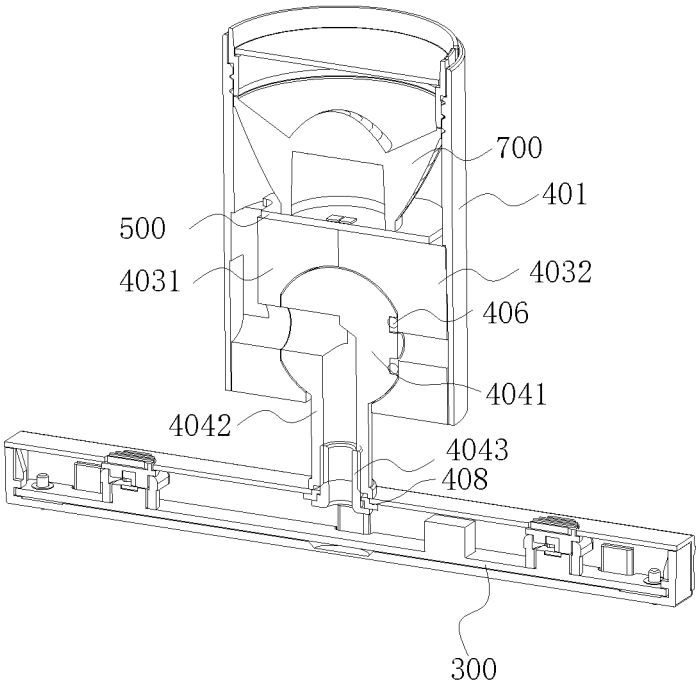
FIG. 6 is a section view of the dimming track lamp (without power supply track) in an embodiment of the present invention.
Figure 7:
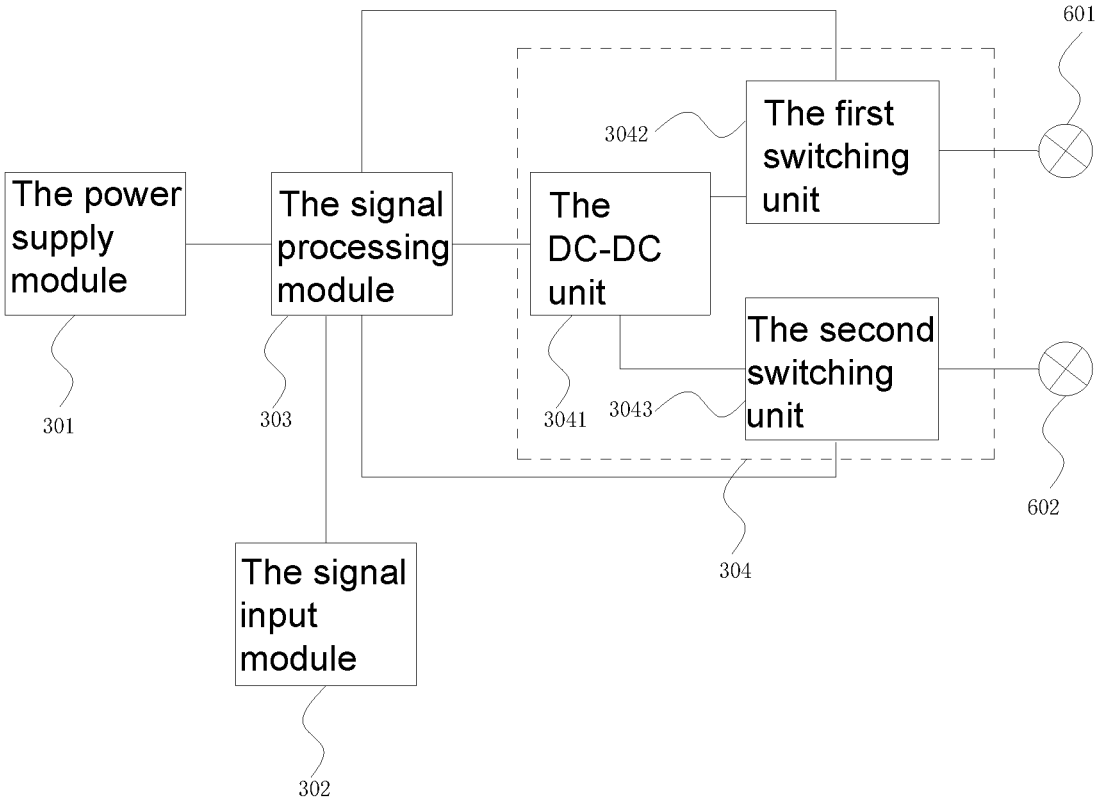
FIG. 7 is a block diagram of the control circuit board of the dimming track lamp in an embodiment of the present invention.
Figure 8:
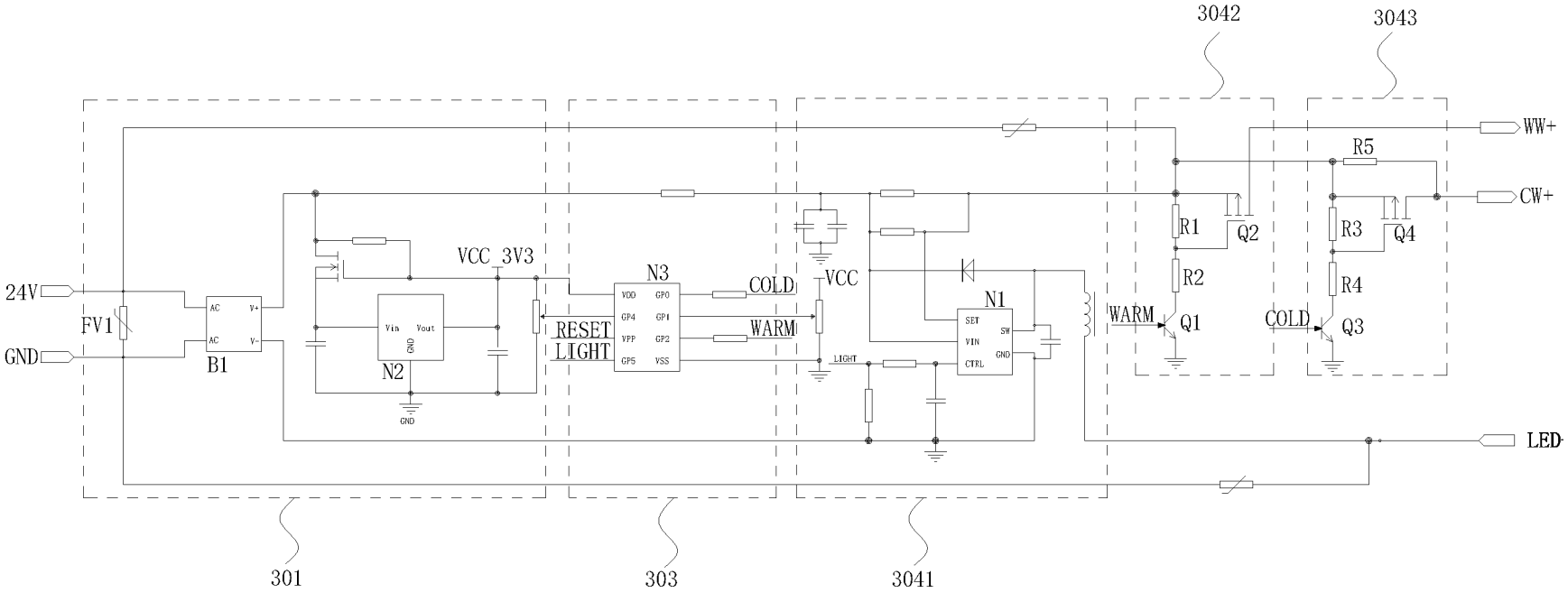
FIG. 8 is a circuit diagram of the control circuit board of the dimming track lamp in an embodiment of the present invention.

Referring to FIG. 1 to FIG. 8, a dimming track lamp in this embodiment comprises an assembly housing 200 which is in detachable connection with the power supply track 100, a control circuit board 300 is in the assembly housing 200 and electrically connected with the power supply track 100, a lamp body 400 arranged on the assembly housing 200, a printed circuit board 500 arranged in the lamp body 400, a light source 600 on the printed circuit board 500 and an optical element 700 arranged in the light output direction of the light source 600, the control circuit board 300 comprises: a power supply module 301 which is electrically connected with the power supply track 100, a signal input module 302, a signal processing module 303 for analyzing and calculating the input signal and generating the control signal, and a signal output module 304 for outputting the control signal to the printed circuit board 500; the light source 600 comprises a warm light source 601 and a cold light source 602, the control signal is used to control the light output of the warm light source 601 and the cold light source 602.

The dimming track lamp in this embodiment is provided with a light source 600 composed of a warm light source 601 and a cold light source 602. By adjusting the light output of the warm light source 601 and the cold light source 602 through the circuit board 300, the brightness and temperature can be adjusted simultaneously, the function of adjusting brightness and color temperature can be realized simultaneously, and the control circuit board 300 is integrated into the assembly housing 200 which is in detachable connection with the power supply track 100, so that the heat generated by the control circuit board 300 controlling the dimming can be dissipated fast through the power supply track 100, so that the volume of the track and the assembly housing can be manufactured smaller, the dimming track lamp has high power and can be used in small track.

In this embodiment, the warm light source 601 adopts two warm LED chips, the cold light source 602 adopts two cold LED chips, and the warm LED chips and the cold LED chips are arranged diagonally to make the light output more uniform.

The matching mode and structure of the assembly housing 200 and the power supply track 100 are the prior art, and there can be multiple matching modes, mainly the matching of the conductive contact on the assembly housing 200 and the conductive strip on the power supply track 100, so that the assembly housing 200 can maintain the electrical connection when it slides in the power supply track 100. The power supply track 100 in this embodiment comprises a track body 101 which is U-shaped and conductive strip 102 arranged at the bottom of the track body 101, the assembly housing 200 comprises at least two conductive contacts 205 electrically connected with the control circuit board 300. When the assembly housing 200 is installed on the power supply track 100 in coordination, the conductive contact 205 and the conductive strip 102 are butted to realize electrical connection.

The signal input module 302 mainly receives the data of the brightness and color temperature to be adjusted, which can be realized by remote control or direct adjustment of the mechanical structure. In order to facilitate the realization of single lamp adjustment, in another embodiment, the signal input module 302 comprises a brightness adjusting knob 3021 and a color temperature adjusting knob 3022 arranged on the assembly housing 200.

In another embodiment, in order to make the structure compact and symmetrical, the assembly housing 200 is a thin strip, which can move in the power supply track 100 along the length direction, the brightness adjusting knob 3021 and the color temperature adjusting knob 3022 are arranged at both ends of the assembly housing 200, and the lamp body 400 is arranged in the middle of the assembly housing 200.

In another embodiment, in order to simplify the circuit, reduce the size of the printed circuit board 500, thereby reducing the size of the assembly housing 200, so that the embodiment can be applied to a smaller power supply track, the signal output module 304 comprises a DC-DC unit 3041 that connected with the signal processing module 303, a first switching unit 3042 connected with the DC-DC unit 3041 for controlling the light output of the warm light source 601, and a second switching unit 3043 connected with the DC- DC unit 3041 for controlling the light output of the cold light source 602, the first switching unit 3042 and the second switching unit 3043 are also connected with the signal processing module 303. Two switching units are led out from the same DC-DC unit 3041, compared with one DC-DC unit corresponding to one switch unit in the prior art, the circuit is simplified.

In another embodiment, specifically, the first switching unit 3042 comprises a first resistor R1, a second resistor R2, a first NPN type triode Q1 and a first PMOS transistor Q2, wherein the first resistor R1 and the second resistor R2 are in series, the other end of the first resistor R1 is connected with the positive output terminal of DC-DC unit 3041, the other end of the second resistor R2 is connected with the collector of the first NPN type triode Q1; the emitter of the first NPN type triode Q1 is grounded, the base is connected with the signal processing module 303; the gate of the first PMOS transistor Q2 is connected on the connection line between the first resistor R1 and the second resistor R2, the source is connected with the positive output terminal of the DC-DC unit 3041, the drain is connected with the positive pole of the warm light source 601, and the negative pole of the warm light source 601 is connected with the negative output terminal of the DC-DC unit 3041.

In another embodiment, specifically, the second switching unit 3043 comprises a third resistor R3, a four resistor R4, a five resistor R5, a second NPN type triode Q3 and a second PMOS transistor Q4, wherein the third resistor R3, and the four resistor R4 are connected in series, the other end of third resistor R3 is connected with the positive output terminal of DC-DC unit 3041, and the other end of four resistor R4 is connected with the collector of the second NPN type triode Q3; the emitter of the second NPN type triode Q3 is grounded, the base is connected with the signal processing module 303; the gate of the second PMOS transistor Q4 is connected on the connection line between the third resistor R3 and the four resistor R4, the source is connected with the positive output terminal of the DC-DC unit 3041, the drain is connected with the positive terminal of the cold light source 602; the negative terminal of the cold light source 602 is connected with the negative output terminal of the DC-DC unit 3041; one end of the five resistor R5 is connected with the positive output terminal of the DC-DC unit 3041, and the other end is connected with the drain of the second PMOS transistor Q4.

In another embodiment, in order to improve the scope of application of the lamp, the lamp body 400 comprises: a shell 401 is provided with a light outlet 402; a rotary seat 403 is fixed in the shell 401, and the printed circuit board 500 is arranged on one side of the rotary seat 403 which toward the light outlet 402; a rotary connecting rod 404, one end is connected with the rotary seat 403 so that the lamp body 400 can rotate vertically around the connecting part, and the other end is connected with the assembly housing 200 so that the lamp body 400 can rotate horizontally around the connecting part. The light outlet 402 is provided with a sealed lamp cover 800 and an outer cover 900.

In another embodiment, in order to improve the heat dissipation effect and reduce the size of the lamp body 400 under the condition of keeping higher power, one end of the rotary connecting rod 404 connected with the rotary seat 403 is a ball head structure 4041, and the rotary seat 403 comprises a first part 4031 and a second part 4032 of a spherical cavity 4033 which can accommodate the rotation of the ball head structure 4041 after splicing. The ball head structure 4041 enables the rotary seat 403 to have a larger contact area with the rotating connecting rod 404, so that the heat on the rotary seat 403 can not only diverge through itself and the shell 401, but also be transmitted to the rotary connecting rod 404, the assembly housing 200 and the power supply track 100, so as to improve the heat dissipation effect. In this embodiment, the first part 4031 and the second part 4032 are connected by bolts 3033.

In another embodiment, in order to make the coordination between the spherical cavity 4033 and the ball head structure 4041 more stable, the interior of the spherical cavity 4033 has an elastic member 406 butted between the ball head structure 4041 and the spherical cavity 4033. The elastic member 406 can provide the support force for the positioning of the lamp body 400. In this embodiment, the elastic member 406 is a sealing ring, the plane where the sealing ring is located is perpendicular to the central line of the rotating shaft of the rotary seat 403, and the central line of the rotating shaft passes through the center of the sealing ring.

In another embodiment, the assembly housing 200 is a thin strip, comprising a base plate 201, a left plate 202, a right plate 203 and a top plate 204 extending along the length direction, and the top plate 204 is provided with a mounting hole which is rotationally matched with the end of the rotary connecting rod 404.

In another embodiment, the assembly housing 200 comprises a rotation limiting member 408 preventing the excessive rotation of the rotary connecting rod 404. It can effectively avoid the winding of internal wires.

In another embodiment, specifically, the rotation limiting member 408 is a limiting gasket located at the inner side of the base plate 201, the rotary connecting rod 404 is provided with a first limiting protrusion 4044, and the limiting gasket is provided with a second limiting protrusion 4081 to resist the first limiting protrusion 4044 to prevent the rotary connecting rod 404 from excessively rotating. The rotary connecting rod 404 includes a threaded main body part 4042 and a fastening part 4043, the first limiting protrusion 4044 is arranged on the fastening part 4043, and the limit gasket is fixed between the fastening part 4043 and the top plate 204 through the threaded connection of the main body part 4042 and the fastening part 4043.

In another embodiment, in order to realize 360° rotation, the outer edge of the limiting gasket extends along the length direction of the assembly housing 200 to form a third limiting protrusion 4082, and the two sides of the third limiting protrusion 4082 are respectively butted with the inner sides of the left plate 202 and the right plate 203, so that the limiting gasket can rotate finitely. The third limiting protrusion 4082 is arranged on both sides of the limit gasket, and the width of the third limiting protrusion 4082 is gradually reduced along the extension direction. This is because in order to improve the heat dissipation effect, the size of the rotary connecting rod 404 and the limit gasket are set as large as possible. In order to ensure a certain turning margin, the width of the third limiting protrusion 4082 is gradually reduced along the extension direction, so that the limit gasket is in the shape of a shuttle.

During the rotation of the rotary connecting rod 404, the first limiting protrusion 4044 at the limit position is first butted with the second limiting protrusion 4081, and then the rotary connecting rod 404 and the limit gasket are turned together to continue to rotate until the third limiting protrusion 4082 is butted with the left plate 202 or the right plate 203, so as to realize 360° rotation and avoid blind area in rotation.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A dimming track lamp, comprising an assembly housing (200) which is in detachable connection with the power supply track (100), a control circuit board (300) is in the assembly housing (200) and electrically connected with the power supply track (100), a lamp body (400) arranged on the assembly housing (200), a printed circuit board (500) arranged in the lamp body (400), a light source (600) on the printed circuit board (500) and an optical element (700) arranged in the light output direction of the light source (600), wherein the control circuit board (300) comprises: a power supply module (301) which is electrically connected with the power supply track (100), a signal input module (302), a signal processing module (303) for analyzing and calculating the input signal and generating the control signal, and a signal output module (304) for outputting the control signal to the printed circuit board (500);

the lamp body comprises a shell (401) provided with a light outlet (402); a rotary seat (403) is fixed in the shell (401), and the printed circuit board (500) is arranged on one side of the rotary seat (403) which faces toward the light outlet (402); a rotary connecting rod (404) having an end connected with the rotary seat (403) so that the lamp body (400) can rotate vertically around the end, and an opposite end is connected with the assembly housing (200) so that the lamp body (400) can rotate horizontally around the opposite end;

the assembly housing (200) is a thin strip, comprising a base plate (201), a left plate (202), a right plate (203) and a top plate (204) extending along the lengthwise direction, and the top plate (204) is provided with a mounting hole which is rotationally matched with the end of the rotary connecting rod (404); and the light source (600) comprises a warm light source (601) and a cold light source (602), the control signal is used to control the light output of the warm light source (601) and the cold light source (602).

2. The dimming track lamp according to claim 1, characterized in that, the signal input module (302) comprises a brightness adjusting knob (3021) and a color temperature adjusting knob (3022) arranged on the assembly housing (200).

3. The dimming track lamp according to claim 2, characterized in that, the assembly housing (200) is a thin strip, which can move in the power supply track (100) along the length direction, the brightness adjusting knob (3021) and the color temperature adjusting knob (3022) are arranged at both ends of the assembly housing (200), and the lamp body (400) is arranged in the middle of the assembly housing (200).

4. The dimming track lamp according to claim 1, characterized in that, the signal output module (304) comprises a DC-DC unit (3041) that connected with the signal processing module (303), a first switching unit (3042) connected with the DC-DC unit (3041) for controlling the light output of the warm light source (601), and a second switching unit (3043) connected with the DC-DC unit (3041) for controlling the light output of the cold light source (602), the first switching unit (3042) and the second switching unit (3043) are also connected with the signal processing module (303).

5. The dimming track lamp according to claim 4, characterized in that, the first switching unit (3042) comprises a first resistor (R1), a second resistor (R2), a first NPN type triode (Q1) and a first PMOS transistor (Q2), wherein the first resistor (R1) and the second resistor (R2) are in series, the other end of the first resistor (R1) is connected with the positive output terminal of DC-DC unit (3041), the other end of the second resistor (R2) is connected with the collector of the first NPN type triode (Q1); the emitter of the first NPN type triode (Q1) is grounded, the base is connected with the signal processing module (303); the gate of the first PMOS transistor (Q2) is connected on the connection line between the first resistor (R1) and the second resistor (R2), the source is connected with the positive output terminal of the DC-DC unit (3041), the drain is connected with the positive pole of the warm light source (601), and the negative pole of the warm light source (601) is connected with the negative output terminal of the DC-DC unit (3041).

6. The dimming track lamp according to claim 4, characterized in that, the second switching unit (3043) comprises a third resistor (R3), a four resistor (R4), a five resistor (R5), a second NPN type triode (Q3) and a second PMOS transistor (Q4), wherein the third resistor (R3), and the four resistor (R4) are connected in series, the other end of third resistor (R3) is connected with the positive output terminal of DC-DC unit (3041), and the other end of four resistor (R4) is connected with the collector of the second NPN type triode (Q3); the emitter of the second NPN type triode (Q3) is grounded, the base is connected with the signal processing module (303); the gate of the second PMOS transistor (Q4) is connected on the connection line between the third resistor (R3) and the four resistor (R4), the source is connected with the positive output terminal of the DC-DC unit (3041), the drain is connected with the positive terminal of the cold light source (602); the negative terminal of the cold light source (602) is connected with the negative output terminal of the DC-DC unit (3041); one end of the five resistor (R5) is connected with the positive output terminal of the DC-DC unit (3041), and the other end is connected with the drain of the second PMOS transistor (Q4).

7. The dimming track lamp according to claim 1, characterized in that, the end of the rotary connecting rod (404) connected with the rotary seat (403) is a ball head structure (4041), and the rotary seat (403) comprises a first part (4031) and a second part (4032) of a spherical cavity (4033) which can accommodate the rotation of the ball head structure (4041) after splicing.

8. The dimming track lamp according to claim 7, characterized in that, the interior of the spherical cavity (4033) has an elastic member (406) butted between the ball head structure (4041) and the spherical cavity (4033).

9. The dimming track lamp according to claim 1, characterized in that, the assembly housing (200) comprises a rotation limiting member (408) preventing the excessive rotation of the rotary connecting rod (404).

10. The dimming track lamp according to claim 9, characterized in that, the rotation limiting member (408) is a limiting gasket located at the inner side of the base plate (201), the rotary connecting rod (404) is provided with a first limiting protrusion (4044), and the limiting gasket is provided with a second limiting protrusion (4081) to resist the first limiting protrusion (4044) to prevent the rotary connecting rod (404) from excessively rotating.

11. The dimming track lamp according to claim 10, characterized in that, the outer edge of the limiting gasket extends along the length direction of the assembly housing (200) to form a third limiting protrusion (4082), and the two sides of the third limiting protrusion (4082) are respectively butted with the inner sides of the left plate (202) and the right plate (203), so that the limiting gasket can rotate finitely.

* * * * *